US005749481A

United States Patent [19]

Miller

[11] Patent Number: 5,749,481

[45] Date of Patent: May 12, 1998

[54] STORAGE RACK AND STRUCTURAL BEAM THEREFOR

[76] Inventor: Myron W. Miller, 723 Greenhouse Patio Dr., Kennesaw, Ga. 30144

[21] Appl. No.: 176,771

[22] Filed: Jan. 3, 1994

[51] Int. Cl.[6] ..... A47F 5/00

[52] U.S. Cl. ..... 211/191; 211/187

[58] Field of Search ..... 211/191, 187, 211/186, 190, 192; 428/595, 122

[56] References Cited

U.S. PATENT DOCUMENTS

| | | | |
|---|---|---|---|
| 862,128 | 8/1907 | Belcher | 211/187 X |
| 3,130,470 | 4/1964 | Bowden et al. | 211/186 X |
| 3,303,937 | 2/1967 | McConnell | 211/187 X |
| 3,951,080 | 4/1976 | Roberts | 211/186 X |
| 4,048,059 | 9/1977 | Evans | 211/187 X |
| 4,101,233 | 7/1978 | McConnell | 211/187 X |
| 4,467,729 | 8/1984 | Featherman | 211/191 X |

*Primary Examiner*—Robert W. Gibson, Jr.
*Attorney, Agent, or Firm*—B. J. Powell

[57] ABSTRACT

A rack system utilizing a structural beam comprises an elongate central web section with a pair of spaced apart, elongate first leg sections integral with opposite side edges of the central web section to form a generally C-shaped cross-sectional shape; and, an elongate second leg section integral with the central web section on that side opposite the first leg sections and positioned intermediate the height of the central web section to support a decking member flush with the top of the structural beam.

10 Claims, 6 Drawing Sheets

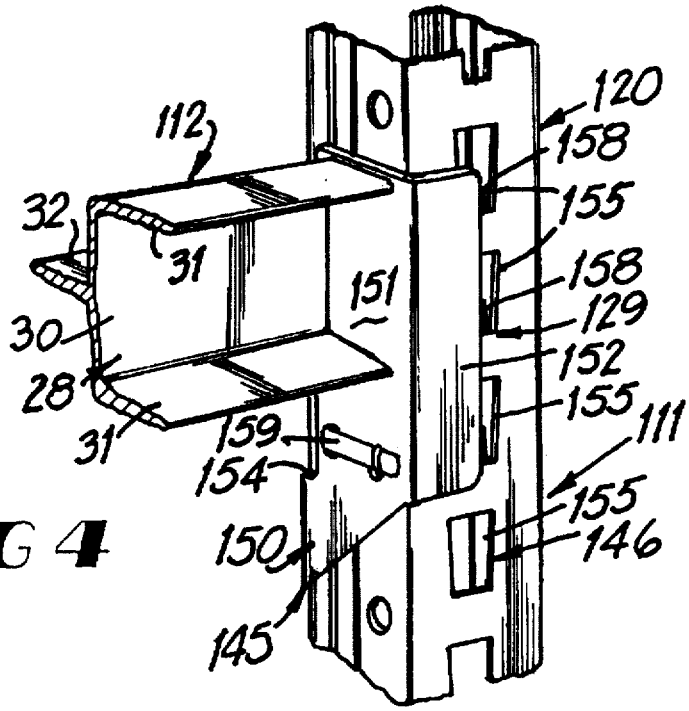
FIG 4
FIG 5
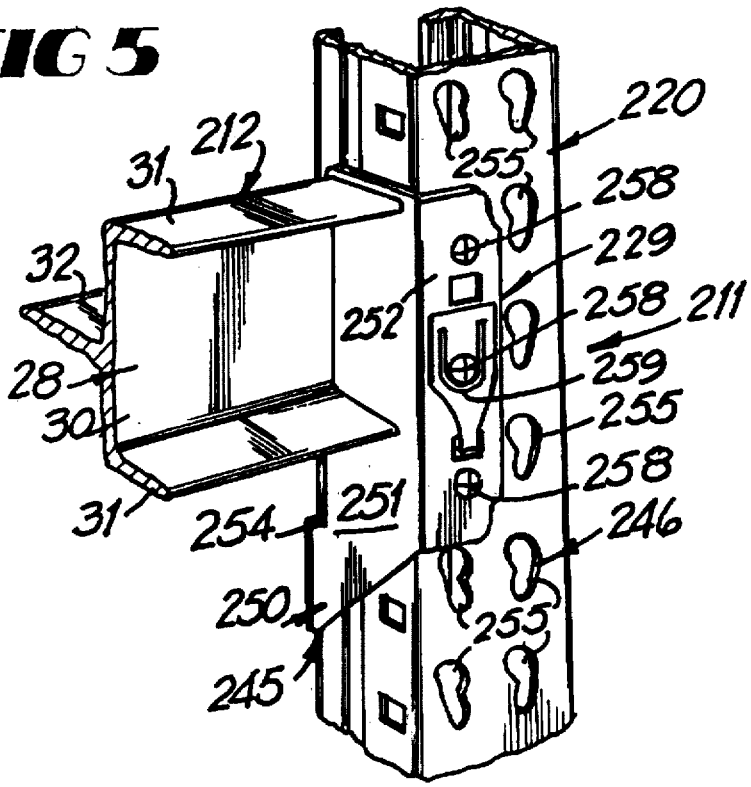

STORAGE RACK AND STRUCTURAL BEAM THEREFOR

BACKGROUND OF THE INVENTION

This invention relates generally to storage rack systems and more particularly to storage rack systems adapted to store both palletized loads and loads on decking members and structural members for use in such systems.

Heretofore storage rack systems have been available for storing both palletized and non-palletized loads. Examples of such prior art systems are illustrated in the following patents:

| PATENT NO. | ISSUE DATE | INVENTOR | TITLE |
|---|---|---|---|
| 3,106,297 | 10/08/63 | W. Schroeder | Pallet Rack |
| 3,070,237 | 12/25/62 | T. J. Fullerton, et al | Pallet Rack |
| 5,190,172 | 03/02/93 | P. R. Tyson | Connection Assembly and Method for a Structural Rack |

The system shown in U.S. Pat. No. 3,106,297 utilizes a fabricated box beam as the primary support for pallets with a flange welded to one side of the box beam to support decking boards between the flanges. These decking boards are used to support non-palletized loads. This construction is expensive to fabricate and requires that the load be carried through the welded joint. As a result, any defects in the welded joint had a detrimental effect on the load carrying capability of the structural member, especially when using decking members to carry the load. Also, the use of decking members on the flanges causes a rotational movement to be imposed on the box beam. This served to impose a shear load on the joints welding the two sections of the box beam together so that any defects in these joints were particularly detrimental to the strength of the structure when using the decking members.

U.S. Pat. No. 3,070,237 discloses a box beam construction in which a recess is formed in the inboard top edge of the beam to form a shoulder to support the ends of the decking members. The additional forming steps to form the shoulder in the section of the beam and the tolerances necessary to insure that the shoulder support surface was horizontal made fabrication of this construction expensive. Further, this construction also served to impose a shear load on the joints welding the two sections of the box beam together so that any defects in these joints were particularly detrimental to the strength of the structure when using the decking members.

U.S. Pat. No. 5,190,172 discloses a C-shaped beam used to support pallets on the upper edge thereof. This construction does not have any way of supporting the decking members below the level of the pallets so that the decking members will not interfere with the loading of pallets and will stay in place as loads are loaded onto and removed from the decking members.

SUMMARY OF THE INVENTION

These and other problems and disadvantages associated with the prior art are overcome by the invention disclosed herein by providing a structural member for a rack storage system that minimizes the manufacturing costs thereof, maximizes the strength of the beam construction, and insures that the decking members and pallets will be adequately supported. The structural beam member is provided with a C-shaped portion to provide the basic support for the loads with an integral leg section that projects out from the opposite side of the C-shaped portion leg sections to provide the support for the ends of the decking members.

The invention is directed to the structural member itself and to the rack system embodying the structural member. The structural beam embodying the invention comprises an elongate central web section with a pair of spaced apart, elongate first leg sections integral with opposite side edges of the central web section to form a generally C-shaped cross-sectional shape; and, an elongate second leg section integral with the central web section on that side opposite the first leg sections and positioned intermediate the height of the central web section. The second leg section defines a planar support surface on the upper side thereof which is located from the upper portion of said structural member a predetermined offset distance corresponding to the thickness of the decking member to be used therewith so that the top of the decking member is flush with the top of the structural beam. The first and second leg sections taper from their ends integral with the central web section toward the projecting ends thereof. The rack system of the invention includes a plurality of upright support subassemblies adapted to be located at spaced apart positions; at least one decking member adapted to support the loads thereon; and, a plurality of load beam subassemblies, each including one of the structural beams described above with connection means operatively associated with the opposed ends of the structural beam for adjustably connecting the structural beam to the upright support subassemblies so that the longitudinal axis of said structural beam is generally horizontal and so that the load beam assemblies can be connected to the upright support subassemblies in spaced apart, generally horizontally aligned pairs with the second leg sections thereon facing each other to support the decking member therebetween.

These and other features and advantages of the invention will become more clearly understood upon consideration of the following detailed description and accompanying drawings wherein like characters of reference designate corresponding parts throughout the several views and in which:

BRIEF DESCRIPTION OF THE DRAWINGS

FIG. 4 is an enlarged perspective view showing a second embodiment of the connection means of the invention;

FIG. 5 is an enlarged perspective view showing a third embodiment of the connection means of the invention;

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
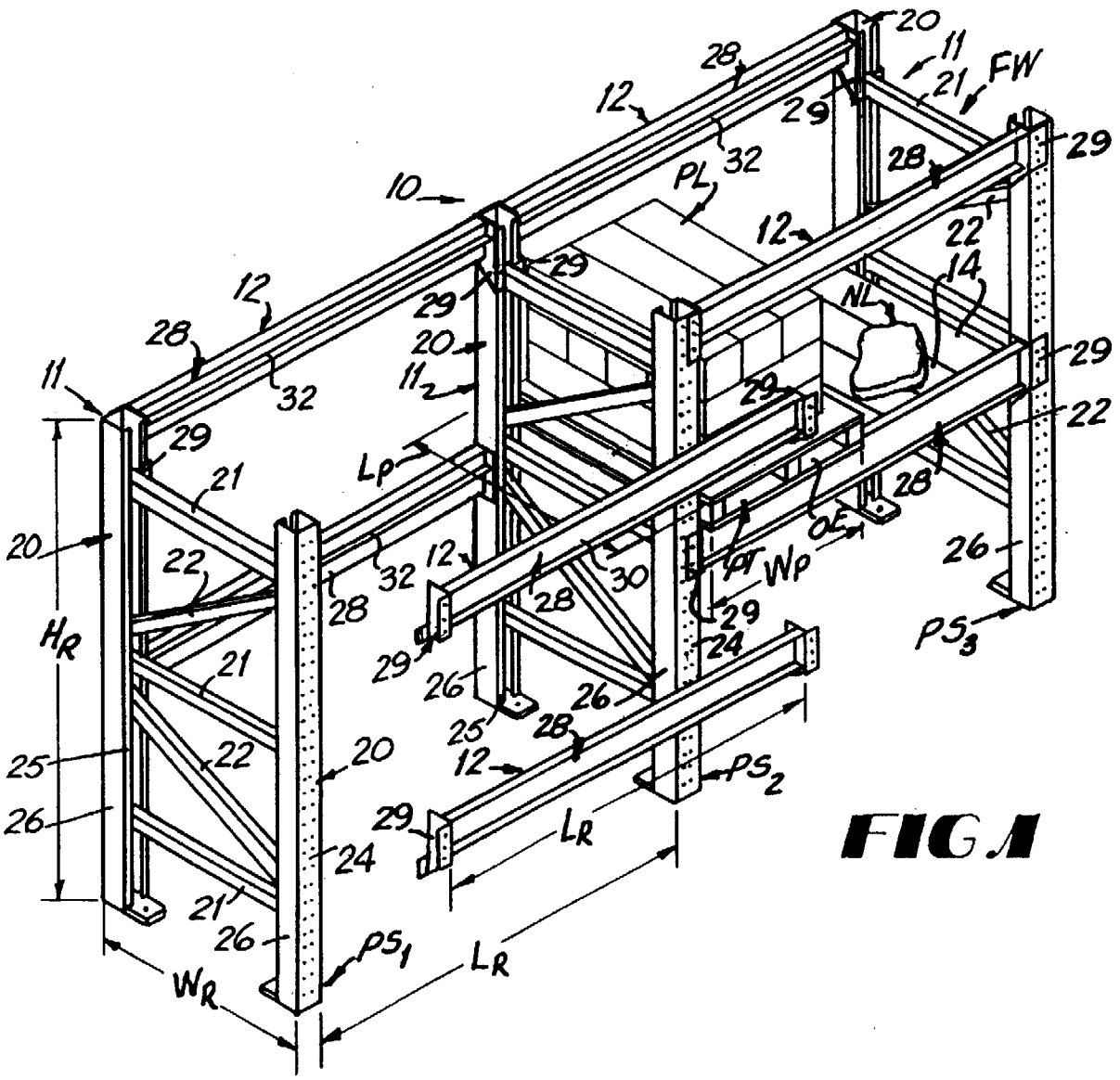
FIG. 1 is a perspective view showing a rack system embodying the invention.

Referring to FIG. 1, the rack system 10 embodying the invention is designed to support palletized loads PL or non-palletized loads NL and includes generally a plurality of upright support subassemblies 11 adapted to be located at spaced apart positions $PS_1$, $PS_2$, $PS_3$, etc. and a plurality of load beam subassemblies 12 adapted to extend between and be connected to the upright support subassemblies 11 to form a generally rectilinear open framework FW. The subassemblies 11 and 12 are sized to selectively support the pallets PT carrying the palletized loads PL thereon or to support decking members 14 thereon so that non-palletized loads NL can be carried on the members 14. When the decking members 14 are in place, pallets PT can be loaded thereover without the decking members 14 interfering with the placement or removal of the pallets.

Typically pallets PT used on storage racks such as the rack system 10 have a relatively standard length or depth $L_P$ while the width $W_P$ may vary depending on the particular load to be carried. A common length $L_P$ is 4 feet and this dimension will be used for illustration. It is to be understood, however, that the concepts disclosed herein are equally applicable to different common length pallets PT. The width $W_P$ is commonly about 3–4 feet although different width ranges can be accommodated without departing from the scope of the inventive concept. Opposite ends OE of the pallet PT are open to receive the tines of the lifting device so that the pallet can be loaded onto and loaded off of the rack system 10.

Figure 7:
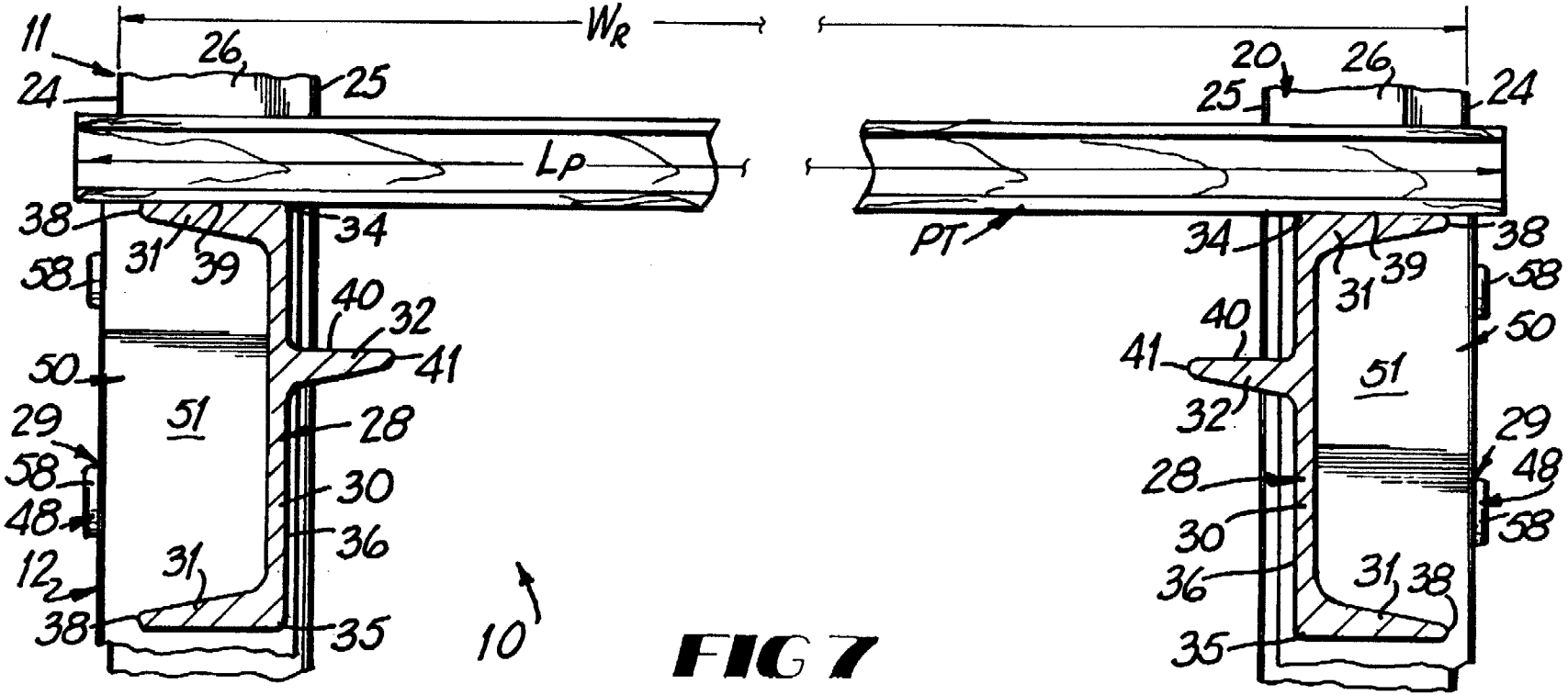

The upright support subassemblies 11 have a standard width $W_R$ that defines the width of the rack system 10 and a convenient height $H_R$ that defines the overall height of the rack system. The width $W_R$ is slightly less than the length $L_P$ of the pallet PT so that the ends of the pallet project over opposite sides of the load beam subassemblies 12 as best seen in FIG. 7. Each of the upright subassemblies 11 comprises a pair of spaced apart upright support posts 20 maintained parallel to each other by cross members 21 and angle braces 22. Sometimes the bottoms of the posts 20 are attached to the floor to secure the rack system 10 in place as will become more apparent. The posts 20 are typically rectilinear in cross-section with an outwardly directed face 24, an inwardly directed face 25, and a pair of opposed side faces 26.

The load beam subassemblies 12 extend between the upright support subassemblies 11 and serve to support the pallets PT or decking members 14 thereon. Each of the load beam subassemblies 12 includes an elongate structural beam 28 with connection means 29 at opposite ends thereof to adjustably connect the load beam subassembly 12 to the upright subassemblies 11. The length $L_R$ of the structural beam 28 is selected to give the desired bay size for the rack system 10 and may be any convenient length. Typical lengths for the beam 28 vary from about 4 feet to about 12 feet in 6 inch intervals.

Figure 2:
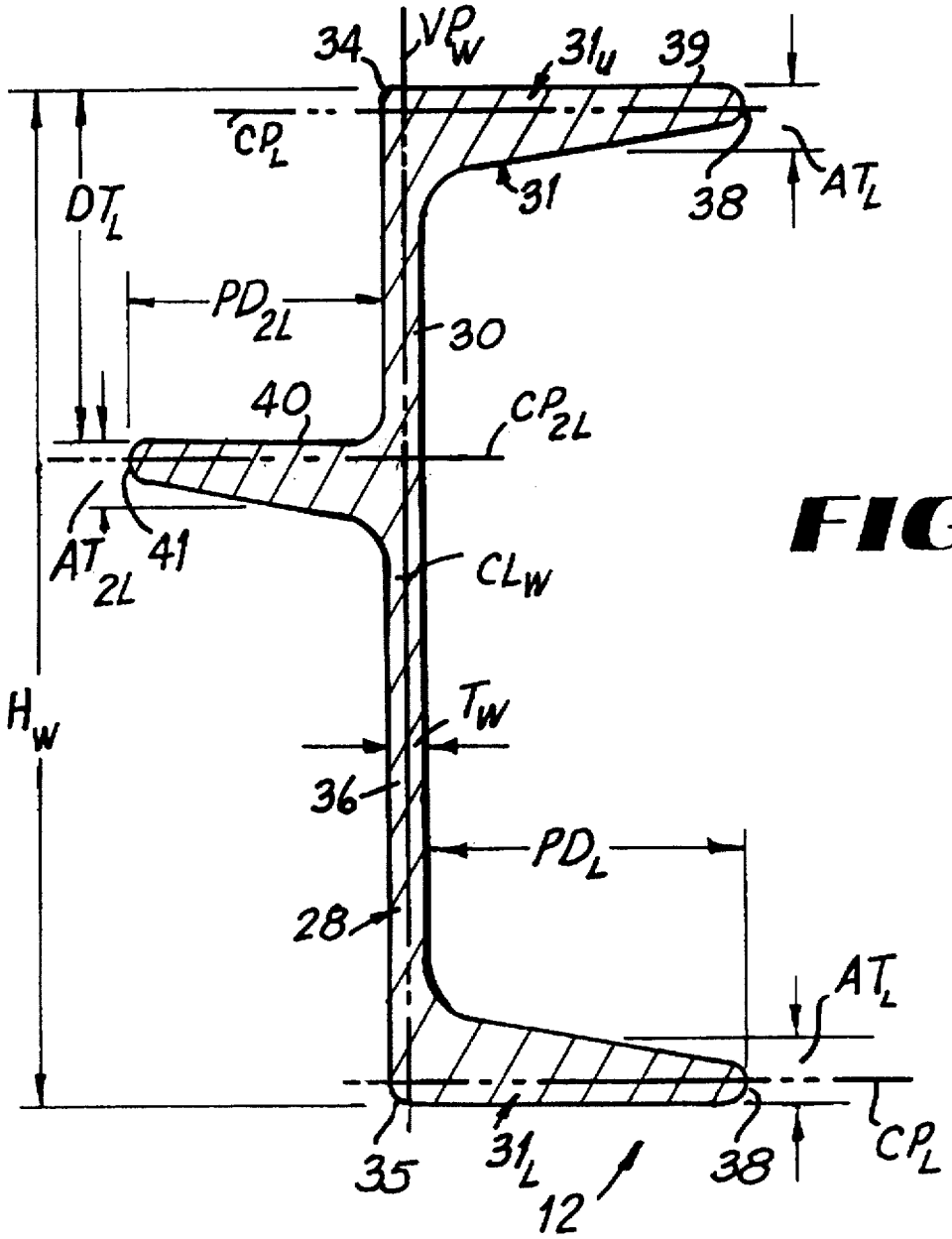
FIG. 2 is an enlarged cross-sectional view of the structural beam embodying the invention.
Figure 3:
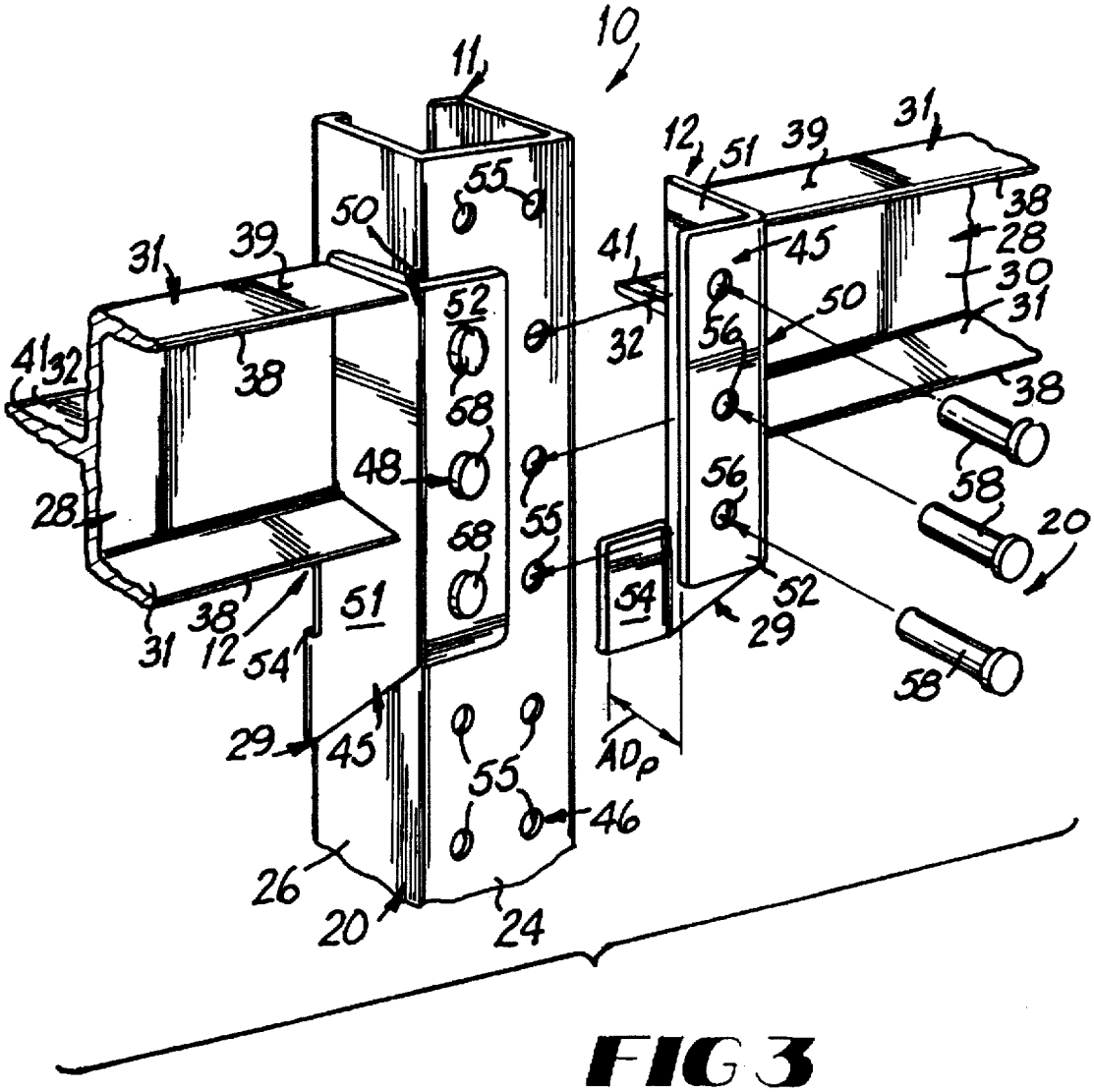
FIG. 3 is an enlarged exploded perspective view showing the first embodiment of the connection means of the invention seen in FIG. 1.

The structural beam 28 as seen in FIGS. 2 and 3 includes an elongate central web section 30 with a first pair of leg sections 31 and a second leg section 32. The central web section 30 extends along the full length of the beam 28 and is designed to be vertically oriented during use. The thickness $T_W$ of the web section 30 and height $H_W$ thereof are determined by the load carrying capacities of the load beam subassembly 28 for the particular length $L_R$ selected for the rack system. Examples of sizes to be used is a web thickness $T_W$ of about 0.150 inch for a height $H_W$ of about 3 inches and a thickness $T_W$ of about 0.184 inch for a height $H_W$ of about 4 inches. The height $H_W$ and thickness $T_W$ are substantially constant along the length of the beam. The central web section 30 has a longitudinal centerline $CL_W$, and defines an upper side edge 34 and a lower side edge 35, both of which are parallel to the centerline $CL_W$. The web section 30 also defines a central vertical web plane $VP_W$ therethrough on which the web section is centered with the centerline $CL_W$ lying in the plane $VP_W$.

The leg sections 31 are integral respectively with the side edges 34 and 35 on central web section 30 and project outwardly from the central web section on one side of web plane $VP_W$ perpendicular thereto. Thus, the pair of first leg sections 31 and the central web section 30 have a C-shaped cross section. The first leg sections have been individually identified as $31_U$ for the leg section integral with the upper side edge 34 on the central web section while leg section $31_L$ is integral with the lower side edge 35 of the central web section. The central leg planes $CP_L$ of the leg sections 31 are parallel to each other and perpendicular to the web plane $VP_W$. Each leg section 31 tapers in thickness from the inboard end integral with the side edge of the central web section 30 toward the projecting end 38 thereof. The amount of taper may be varied as desired but is illustrated as a standard taper associated with C-channels. The outwardly facing side surface 39 on each of the leg sections 31 is oriented normal to the web plane $VP_W$ so that the surface 39 on the upper leg section $31_U$ supports the pallet PT across the entire leg section. The average thickness $AT_L$ of the leg section 31 is illustrated as about 1.6 times the thickness $T_W$ of the associated web section 30, however, it is to be understood that different criteria may be used to determine the average thickness of the leg sections 31. Each of the leg sections 31 also project from the near side of the web section a prescribed projection distance $PD_L$ of about 1.25 inch as a base amount for a base web height of about 3 inches and varies as a ratio of the desired beam height/base web height. For different applications, however, it is to be understood the different projection distances PDL may be used as well as different criteria.

The second leg section 32 is also integral with central web section 30 and is located between the opposite side edges 34 and 35 on the central web section 30. The second leg section 32 projects outwardly from central web section 30 from that side opposite the first leg sections 31 and in the opposite direction from the leg sections 31. Like leg sections 31, the second leg section 32 has a central leg plane $CP_{2L}$ perpendicular to web plane $VP_W$ so that the second leg section 32 and central web section 30 define a generally T-shaped cross-sectional shape. The second leg section 32 is parallel to the first leg sections 31 and defines an upper support surface 40 thereon to support decking members 14 thereon as will become more apparent. The upper support surface 40 is perpendicular to the web centerline $CL_W$ to insure that the decking members 14 will be supported across the full surface area of the second leg section 32. Like the first leg sections, the second leg section 32 tapers in thickness from the near end integral with the central web section toward the projecting end 41 thereon to produce an average thickness. Because the leg section 32 supports the ends of the decking members 14, it projects from the central web section a standard prescribed projection distance $PD_{2L}$ of about 1.25 inch and the surface 40 is spaced below the upper surface 39 a distance $DT_L$ corresponding to or slightly greater than the thickness of the decking member 14. This insures that the decking members 14 will lie flush with the upper support side surface 39 and the beam 30.

Each connection means 29 best seen in FIG. 3 serves to adjustably connect one end of the structural beam 28 to the posts 20. The connection means 29 includes a beam arrangement 45 mounted on the end of the beam 25 and a post arrangement 46 on the post 20 which cooperate with each other to positively interconnect the load beam subassemblies 12 to the posts 20 in the upright support subassemblies 11 with attachment means 48. FIGS. 1 and 3 illustrate the first embodiment of the connection means 29 in which the post arrangement 46 includes an upright connector plate 50 with a generally rectilinear base section 51 attached to the end of the beam 28 and oriented normal to the base plane $VP_W$. The connector plate 50 also includes an attachment section 52 integral with the outside side edge of the section 51 and projects outwardly therefrom parallel to the web plane $VP_W$ and in a direction opposite the beam 28. The inside of the attachment section 52 is adapted to lie against the outwardly directed face 24 on the post 20. The base section 51 projects below the beam 28 and the inwardly projecting edge thereon is provided with an arresting section 54 that is oriented parallel to the attachment section 52 and spaced therefrom a distance $AD_P$ such that the arresting section 54 will lie against the inwardly directed face 25 of the post 20 when the attachment section 52 lies against the outwardly directed face 24 of the post. Thus, the sections 52 and 54 serve as an antirotation means when the decking members 14 exert a rotational moment about the centerline $CL_W$ as will become more apparent.

The post arrangement 46 includes a plurality of attachment holes 55 that are spaced along the length of the posts 20. The holes 55 are selectively registrable with complementary holes 56 through the attachment section 52 of the connector plate 50. To vertically locate the beam subassembly 12 at a desired location vertically along the length of the posts 20, the attachment means 48 includes removable attachment pins 58. The pins 58 can be inserted through the holes 56 and the holes 55 in registration therewith to vertically fix the load beam assembly 12 to the post. Thus, the vertical loads exerted on the load beam assembly 12 are carried through the pins 58 while the rotational moments around the beam centerline $CL_W$ are resisted by the sections 52 and 54 on the connector plate 50.

Figure 6:
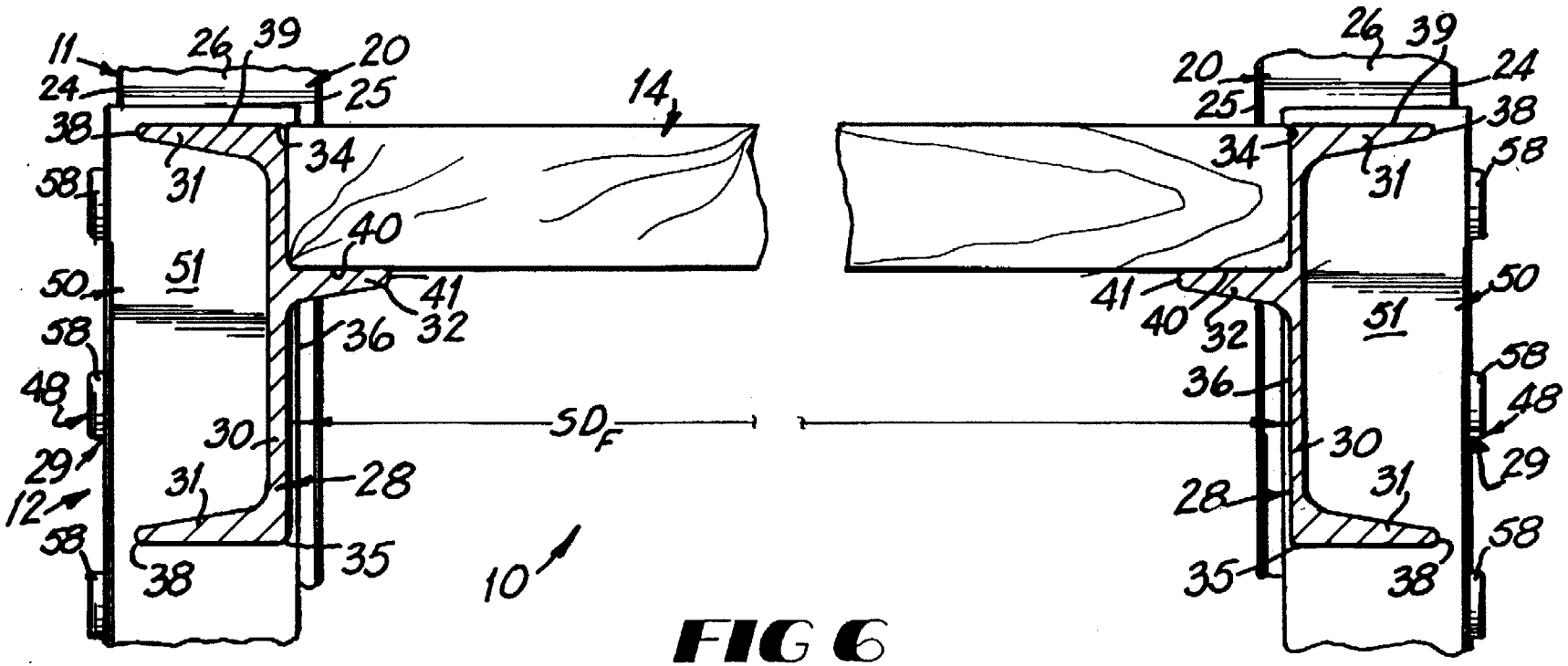
FIG. 6 is an enlarged transverse cross-sectional view of the rack system of the invention illustrating the supporting of the decking members; and, FIG. 7 is an enlarged transverse cross-sectional view of the rack system of the invention illustrating the supporting of pallets.

FIGS. 6 and 7 illustrate the rack system 10 assembled and in use. It will be noted that the posts 20 and load beam subassemblies 12 are used in pairs to support the pallets PT as seen in FIG. 7 or decking members 14 seen in FIG. 6 therebetween. When the rack system 10 is assembled, the inside faces 36 on the central webs 30 of the opposed structural beams 28 are spaced apart a distance $SD_F$. The lengths of the decking members 14 are selected to match the distance $SD_F$ so that the decking members 14 will just fit between the opposed faces 36 with opposite ends of the decking member 14 supported by the second legs 32 on the opposed structural beams 28 as seen in FIG. 6. The distance $DT_L$ that the upper surface 40 on the second leg section 32 is spaced below the upper side surface 39 on the first leg section 31 is selected to be substantially equal to or slightly more than the thickness of the decking members 14. The decking members 14 may be wood or metal and are typically about 1⅝ inches.

Second Embodiment

A second embodiment of the connection means is illustrated in FIG. 4 and is designated 129. The connection means 129 is similar to means 29 in that it has a beam arrangement 145 and a post arrangement 146. The post arrangement 145 includes an upright connector plate 150 with a base section 151, an attachment section 152, and an arresting section 154 that function basically like the corresponding parts of the first embodiment of the invention. The post arrangement 146 includes a plurality of sets of tapered cutouts 155 and the projecting edge of the attachment section 152 on the beam arrangement 145 mounts attachment hooks 158 thereon that can be hooked into the cutouts 155 to mount the load beam subassembly 112. To engage the hooks 158, the installer rotates the load beam subassembly 112 until the post 120 will fit between the attachment section 152 and the arresting section 154. The beam subassembly 112 is fitted around the post 120 and rotated back into position so that the hooks 158 can be inserted into the cutouts 155 and the beam subassembly 112 lowered to cause the hooks 158 to engage the posts 120 in the cutouts 155. Appropriate locking mechanisms 159 may be provided to keep the hooks 158 engaged until the locking mechanisms 159 are released.

Third Embodiment

A third embodiment of the connection means is illustrated in FIG. 5 and is designated 229. The connection means 229 is similar to means 29 and 129 in that it has a beam arrangement 245 and a post arrangement 246. The post arrangement 245 includes an upright connector plate 250 with a base section 251, an attachment section 252, and an arresting section 254 that function basically like the corresponding parts of the first and second embodiments of the invention. The post arrangement 246 includes a plurality of sets of keyhole cutouts 255 and the attachment section 252 on the beam arrangement 245 mounts headed attachment pins 258 thereon that can be hooked into the cutouts 255 to mount the load beam subassembly 212. To engage the pins 258, the installer rotates the load beam subassembly 212 until the post 220 will fit between the attachment section 252 and the arresting section 254. The beam subassembly 212 is fitted around the post 220 and rotated back into position so that the pins 258 can be inserted into the cutouts 255 and the beam subassembly 212 lowered to cause the heads on the pins 258 to engage the posts 220 in the smaller portion of the cutouts 255. Appropriate locking mechanisms 259 may be provided to keep the pins 258 engaged until the locking mechanisms 259 are released.

What is claimed as invention is:

1. A structural beam for use with a decking member having opposed ends comprising:

an elongate planar central web section having a unitary cross-section and defining a longitudinal central axis along the length thereof, a web plane extending longitudinally thereof along which said axis extends, and side edges thereon on opposite sides of and parallel to said central axis;

a pair of spaced apart, elongate first leg sections, each of said first leg sections having a unitary cross-section and defining a first inboard end and a first projecting end thereon, each of said first leg sections integral with one of said side edges of said central web section at said first inboard end thereof and projecting outwardly from said central web section on one side of and substantially perpendicular to said web plane so that said first projecting end of each of said first leg sections is spaced a prescribed distance from said central plane, and so that said first leg sections and said central web section define a generally U-shaped cross-sectional shape; and, an elongate second leg section having a unitary cross-section and defining a second inboard end and a first projecting end thereon said second leg section integrally joining said central web section at said second inboard end thereof along a path parallel to said central axis of said central web section and spaced inboard of the opposed side edges of said central web section; said second leg section projecting out from said central web section on that side of said web plane opposite said first leg sections; oriented perpendicular to said web plane;

and, oriented substantially parallel to said first leg sections, said second leg section further defining a secondary planar support surface on one side thereof oriented perpendicular to said web plane so that when said beam is oriented generally horizontally while said web plane is generally vertically oriented and said secondary planar support surface is facing upwardly, one end of the decking member can be supported on said secondary planar support surface.

2. A structural beam for use with a decking member comprising:

an elongate central web section defining a longitudinal central axis along the length thereof, a web plane extending longitudinally thereof along which said axis extends, and opposed parallel side edges thereon:

a pair of spaced apart, elongate first leg sections, each of said first leg sections integral with one of said side edges of said central web section and projecting outwardly from said central web section on one side of and substantially perpendicular to said web plane so that said first leg sections and said central web section define a generally U-shaped cross-sectional shape; and, an elongate second leg section integral with said central web section intermediate the distance between the opposed side edges of said central web section: projecting out from said central web on that side of said web plane opposite said first leg sections; oriented perpendicular to said web plane; and, oriented substantially parallel to said first leg sections, wherein said second leg section defines a secondary planar support surface on one side thereof oriented perpendicular to said web plane so that when said beam is oriented generally horizontally while said web plane is generally vertically oriented and said secondary planar support surface is facing upwardly, one end of the decking member can be supported on said secondary planar support surface, and wherein said second leg section tapers in thickness from that end integral with said central web section toward that end projecting outwardly from said central web section.

3. The structural beam of claim 2 wherein the decking member has a prescribed thickness and wherein said planar support surface on said second leg section is located from the upper portion of said structural member a predetermined offset distance corresponding to the thickness of the decking member.

4. The structural beam of claim 3 wherein each of said first leg sections tapers in thickness from that end integral with said central web section toward that end projecting outwardly from said central web section.

5. The structural beam of claim 2 wherein said second leg section has a projecting length about equal to the projecting length of each of said first leg sections.

6. The structural beam of claim 3 wherein said first and second leg sections have a common projecting length projecting from said central web.

7. A rack system for supporting loads comprising:

a plurality of upright support subassemblies adapted to be located at spaced apart positions;

a least one decking member adapted to support the loads thereon and defining opposed beam support ends thereon; and, a plurality of load beam subassemblies adapted to extend between and be connected to said upright support subassemblies to form an open generally rectilinear framework sized to support said decking member therebetween, each of said load beam subassemblies comprising:

a structural beam having opposed ends and including:

an elongate central web section defining a longitudinal central axis along the length thereof, a web plane extending longitudinally thereof along which said axis extends, and opposed parallel side edges thereon, a pair of spaced apart, elongate first leg sections, each of said first leg sections integral with one of said side edges of said central web section and projecting outwardly from said central web section on one side of and substantially perpendicular to said web plane so that said first leg sections and said central web section define a generally U-shaped cross-sectional shape, and an elongate second leg section integral with said central web section intermediate the distance between the opposed side edges of said central web section, projecting out from said central web on that side of said web plane opposite said first leg sections, oriented substantially perpendicular to said web plane, tapering in thickness from that end integral with said central web section toward that end projecting outwardly from said central web section and oriented substantially parallel to said first leg sections; and, connection means operatively associated with said opposed ends of said structural beam for adjustably connecting said structural beam to said upright support subassemblies so that the longitudinal axis of said structural beam is generally horizontal and so that said load beam assemblies can be connected to said upright support subassemblies in spaced apart, generally horizontally aligned pairs with said second leg sections thereon facing each other to support said decking member therebetween.

8. The rack system of claim 7 wherein said decking member has a prescribed thickness, wherein each of said load beam subassemblies defines an upper edge thereon, and wherein each of said leg sections is spaced a distance below said upper edge of said load beam subassembly corresponding to said prescribed thickness of said decking member so that said decking member will be supported on said second leg sections and be flush with said upper edge on said load beam subassembly.

9. The rack system of claim 7 for use with loads supported on pallets wherein one of said first leg sections on each of said structural beams defines an upwardly facing planar pallet support surface thereon so that the pallets will be supported on said pallet support surfaces of said support beams of said pair of load beam subassemblies.

10. The rack system of claim 8 for use with loads supported on pallets wherein one of said first leg sections on each of said structural beams defines an upwardly facing planar pallet support surface thereon so that the pallets will be supported on said pallet support surfaces of said support beams of said pair of load beam subassemblies while non-palletized loads will be supported on said decking member.

* * * * *